US011286096B2

(12) United States Patent
Murray

(10) Patent No.: US 11,286,096 B2
(45) Date of Patent: Mar. 29, 2022

(54) OPENING MECHANISM FOR PLASTIC VIAL

(71) Applicant: Pouch Pac Innovations, LLC, Sarasota, FL (US)

(72) Inventor: R. Charles Murray, Sarasota, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 213 days.

(21) Appl. No.: 15/474,256

(22) Filed: Mar. 30, 2017

(65) Prior Publication Data

US 2017/0283145 A1 Oct. 5, 2017

Related U.S. Application Data

(60) Provisional application No. 62/315,261, filed on Mar. 30, 2016.

(51) Int. Cl.

| | |
|---|---|
| ***B65D 75/58*** | (2006.01) |
| ***B65B 3/02*** | (2006.01) |
| ***B65B 9/04*** | (2006.01) |
| ***B65B 51/10*** | (2006.01) |
| ***B65B 61/00*** | (2006.01) |
| ***B65D 75/52*** | (2006.01) |
| ***B65D 35/10*** | (2006.01) |
| ***B65D 75/32*** | (2006.01) |
| ***B65B 61/18*** | (2006.01) |

(52) U.S. Cl.

CPC ..... *B65D 75/5811* (2013.01); *B65B 3/022* (2013.01); *B65B 9/042* (2013.01); *B65B 51/10* (2013.01); *B65B 61/007* (2013.01); *B65D 35/10* (2013.01); *B65D 75/323* (2013.01); *B65D 75/527* (2013.01); *B65B 61/18* (2013.01); *B65B 2220/22* (2013.01)

(58) Field of Classification Search

CPC ..... B65D 75/5811; B65D 75/323; B65D 75/527; B65D 35/10; B65D 2575/32–329; B65B 3/022; B65B 9/042; B65B 51/10; B65B 61/007; B65B 61/18; B65B 2220/22

USPC ..... 53/412; 220/268

See application file for complete search history.

(56) References Cited

U.S. PATENT DOCUMENTS 3,741,384 A * 6/1973 Cloud ..... B65D 75/366 206/461
3,782,066 A * 1/1974 Schmitt ..... A61J 1/067 53/412
4,871,091 A * 10/1989 Preziosi ..... A61F 9/0008 222/92
5,275,491 A * 1/1994 Kuge ..... B65D 33/2533 383/120
D369,212 S * 4/1996 Snell ..... D9/696
5,535,885 A * 7/1996 Daniel ..... B65D 1/095 206/484
D392,184 S * 3/1998 Weiler ..... D9/696
(Continued)

*Primary Examiner* — Dariush Seif
(74) *Attorney, Agent, or Firm* — Dinsmore & Shohl LLP

(57) ABSTRACT

The plastic vial for dispensing highly viscous or semisolid materials is formed of two sheets of thermoformable plastic. Sheets are thermoformed to form a raised profile defining a cavity. The profile has a spout portion with a parting line extends across the spout portion through particular sheet. A bending top portion of the vial snaps the parting line forming an opening in the spout to permit access to the contents.

2 Claims, 5 Drawing Sheets

(56) References Cited

U.S. PATENT DOCUMENTS 5,932,235 A * 8/1999 Ninomiya ..... A61J 1/067 424/401
6,776,307 B1 * 8/2004 Hagihara ..... B65D 75/48 222/107
D515,936 S * 2/2006 Ko ..... D9/696
7,004,322 B1 * 2/2006 Bartoli ..... B65D 75/5811 206/484
7,121,409 B1 * 10/2006 Hamilton ..... B65B 9/042 206/484.2
7,219,816 B1 * 5/2007 Xia ..... A61J 1/067 222/209
D565,193 S * 3/2008 Price ..... D24/224
7,506,762 B2 * 3/2009 Nelson ..... B65B 61/02 206/229
7,552,823 B2 * 6/2009 Schuehrer ..... A45D 34/04 206/469
D618,339 S * 6/2010 Hansen ..... D24/115
8,028,837 B2 * 10/2011 Gerstle ..... B65D 75/585 206/449
8,047,394 B2 * 11/2011 Hansen ..... B65D 1/095 220/284
8,141,709 B2 * 3/2012 Klaus ..... B65D 50/06 206/484
8,377,029 B2 * 2/2013 Nagao ..... A61J 1/067 604/403
8,403,161 B2 * 3/2013 Van Puijenbroek ..... B65D 17/4012 220/4.21
8,464,918 B1 * 6/2013 Harris ..... B65D 47/10 222/541.6
8,485,360 B2 * 7/2013 Teys ..... B65D 75/366 206/469
8,523,016 B2 * 9/2013 Teys ..... B65D 75/367 222/107
8,528,736 B2 * 9/2013 Teys ..... A47G 21/004 206/532
9,173,728 B2 * 11/2015 Wurtz ..... A61D 7/00
9,327,044 B2 * 5/2016 Olchovy ..... A61L 9/12
10,159,823 B2 * 12/2018 Tidwell ..... B65D 75/585
D854,183 S * 7/2019 Murray ..... D24/224
2002/0132069 A1 * 9/2002 Kose ..... B65D 75/22 428/35.2
2003/0085298 A1 * 5/2003 Schuehrer ..... A45D 34/02 239/34
2005/0011794 A1 * 1/2005 Caldwell ..... B65D 75/52 206/466
2007/0023301 A1 * 2/2007 Pham ..... B65D 75/5844 206/264
2007/0228073 A1 * 10/2007 Mazzarino ..... B65D 75/5811 222/107
2009/0071978 A1 * 3/2009 Sharp ..... B65D 1/32 222/107
2009/0071979 A1 * 3/2009 Sharp ..... B65D 5/54 222/107
2010/0116772 A1 * 5/2010 Teys ..... A45D 34/04 215/228
2012/0223075 A1 * 9/2012 Teys ..... B65D 75/366 220/268
2013/0001123 A1 * 1/2013 Greenland ..... B65B 3/02 206/462
2014/0023775 A1 * 1/2014 Fox ..... A23G 9/42 426/660
2014/0228785 A1 * 8/2014 Soll ..... A61J 1/065 604/310

* cited by examiner

OPENING MECHANISM FOR PLASTIC VIAL

CROSS-REFERENCE TO RELATED APPLICATIONS

This Application claims the benefit of U.S. Provisional Application 62/315,261 filed on Mar. 30, 2016.

FIELD OF THE INVENTION

The invention relates to plastic vials and more particularly to an opening mechanism for vials molded from plastic sheets.

BACKGROUND OF THE INVENTION

It is known to form plastic vials from two overlaid sheets of plastic material. The vial has a profile of the little shape molded into the center with a peripheral planar portion extending around the profile. The profile generally has a bottom cylindrical portion with an upper conical spout portion which is used to dispense the contents in the spout. The vials are opened by cutting across the top of the conical portion to form an opening. However, the present packaging requires having a utensil such as a knife or scissors to make the cut across the spout to open the pouch. It would be advantageous to have a simplified opening method for such pouches.

SUMMARY OF THE INVENTION

A vial for holding the contents, particularly viscous contents such as creams, lotions and gels includes a body having a pair of sides a top end and a bottom end. The body is formed with a top sheet and a bottom sheet of plastic material. The body has a bottle shaped raised profile formed to define a cavity for holding the contents. The raised profile has a spout portion which extends towards the top. A scored line extends partially through the top of the spout portion on one side for opening the cavity to access the contents.

A method of forming the vial includes thermoforming a pair of plastic sheets to form a body with a raised portion defining a cavity and opening at one end and having a pair of flanges extending from the opening. The raised portion also has a tapered spout portion method further includes supporting a body with the opening and the flanges extending upwardly, filling the cavity with material sealing the flanges together to close the cavity and forming a score line partially through the spout portion of one sheet.

DETAILED DESCRIPTION OF THE PREFERRED EMBODIMENTS

Figure 2:
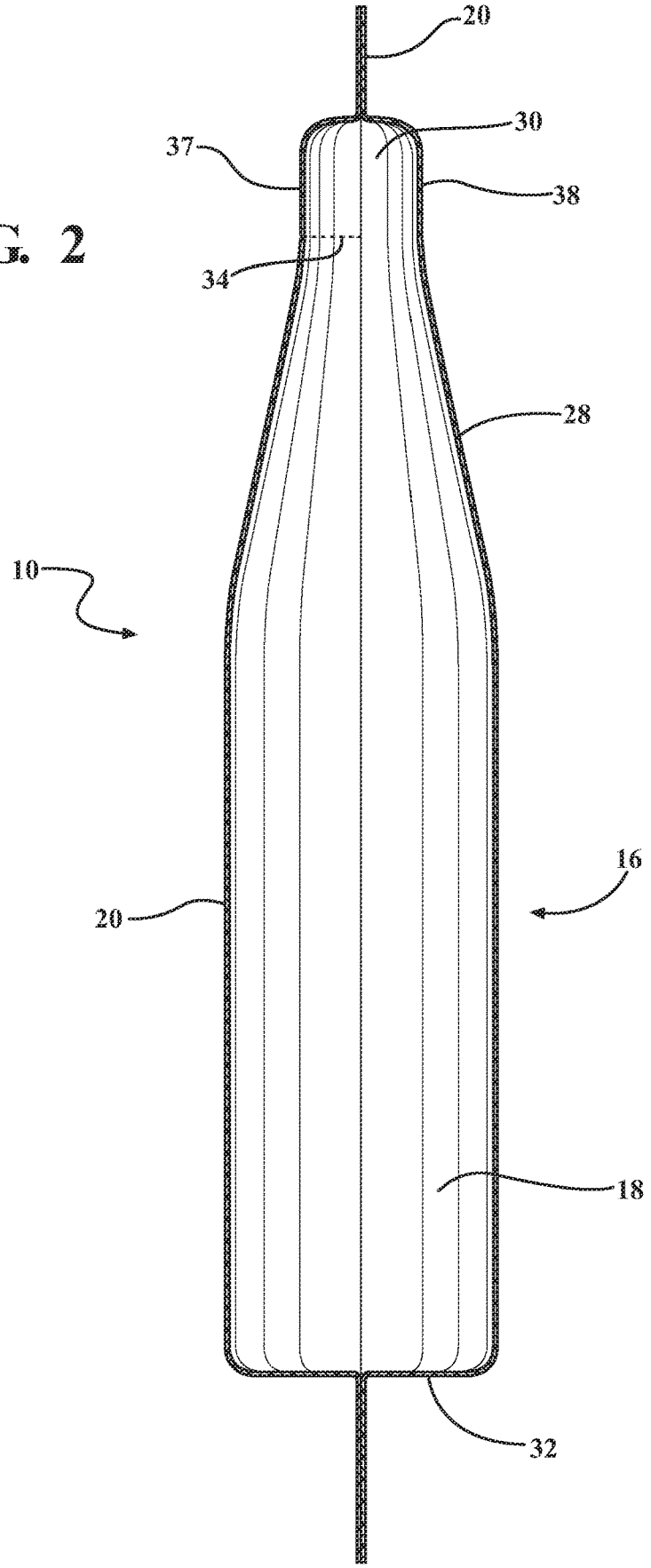
FIG. 2 is a cross sectional view of a vial taken across the center line 2-2.
Figure 3:
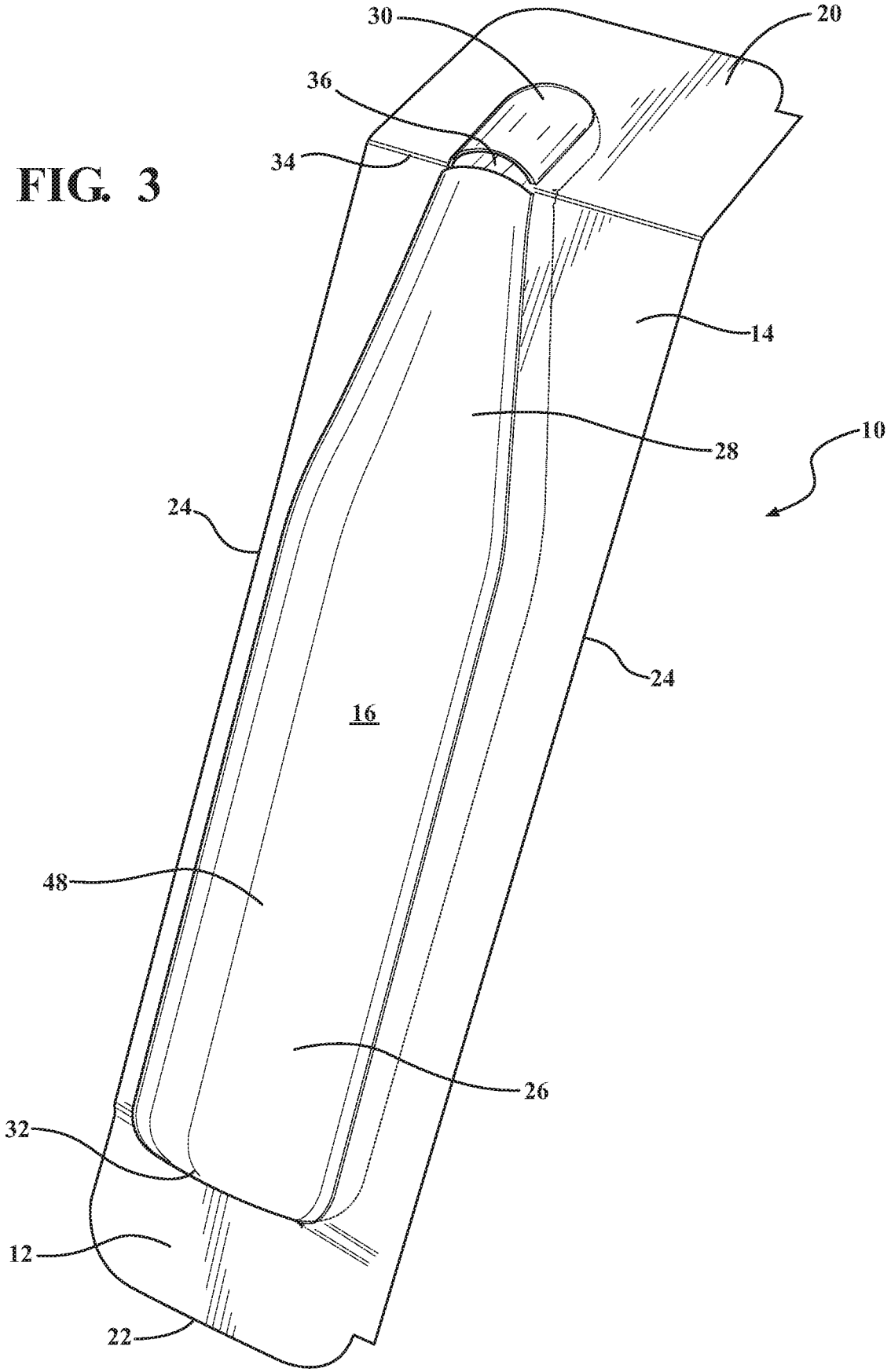
FIG. 3 is a perspective view of a vial shown after opening.

A novel vial 10 for containing squeezable, highly viscous, or semisolid material is best shown in FIGS. 2 and 3. The vial 10 contains has a cavity 14 to hold materials such as lotions or gels. The vial 10 has a parting line 34 to permit the vial snap open to dispense the contents 11. The vial 10 has a body 12 a front side with as a peripheral planar portion 14 extending around a central bottle shaped raised portion 16. The raised portion defines a cavity 18 for holding the contents of the vial. The body has a top 20, bottom 22 and a pair of sides 24. The raised portion extends outwardly in both directions from the planar portion 14 to form a cylindrical portion 26 and a spout portion 28. The spout portion tapers inwardly to a tip 30. The cylinder portion has a bottom wall 32.

As shown in FIG. 2, the body is formed by two plastic sheets 37, 38. A parting line extends 34 from side to side across the planar portion 14 and across the spout 28 near the tip 20 of the top sheet 37. The parting line is laser cut approximately 50% of the thickness of the top sheets 36. The preferred material is a laminate of PVC/EVOH/PE. PVC is poly vinyl chloride, EVOH is Ethylene vinyl and PE is poly ethelene. The PVC is an outer layer and the PE is an adhesive for bonding the two sheets together. The laminate results in a relatively soft sheet material. The sheets are flexible and thin. However when the cavity is filled and sealed, the air in the spout is compressed to make the raised profile rigid. Thus, it is possible to grasp on the top 20 of the vial 10 near the tip 30 and bend the top away from the parting line to snap the parting line 34 to form an opening 36 as shown in FIG. 3. Once opened, the raised profile becomes flexible allowing the user to easily control dispensing of the contents 11 with pressure on the cylindrical portion 16 to force the contents 11 out of the opening 36 in a desired quantity.

Figure 1:
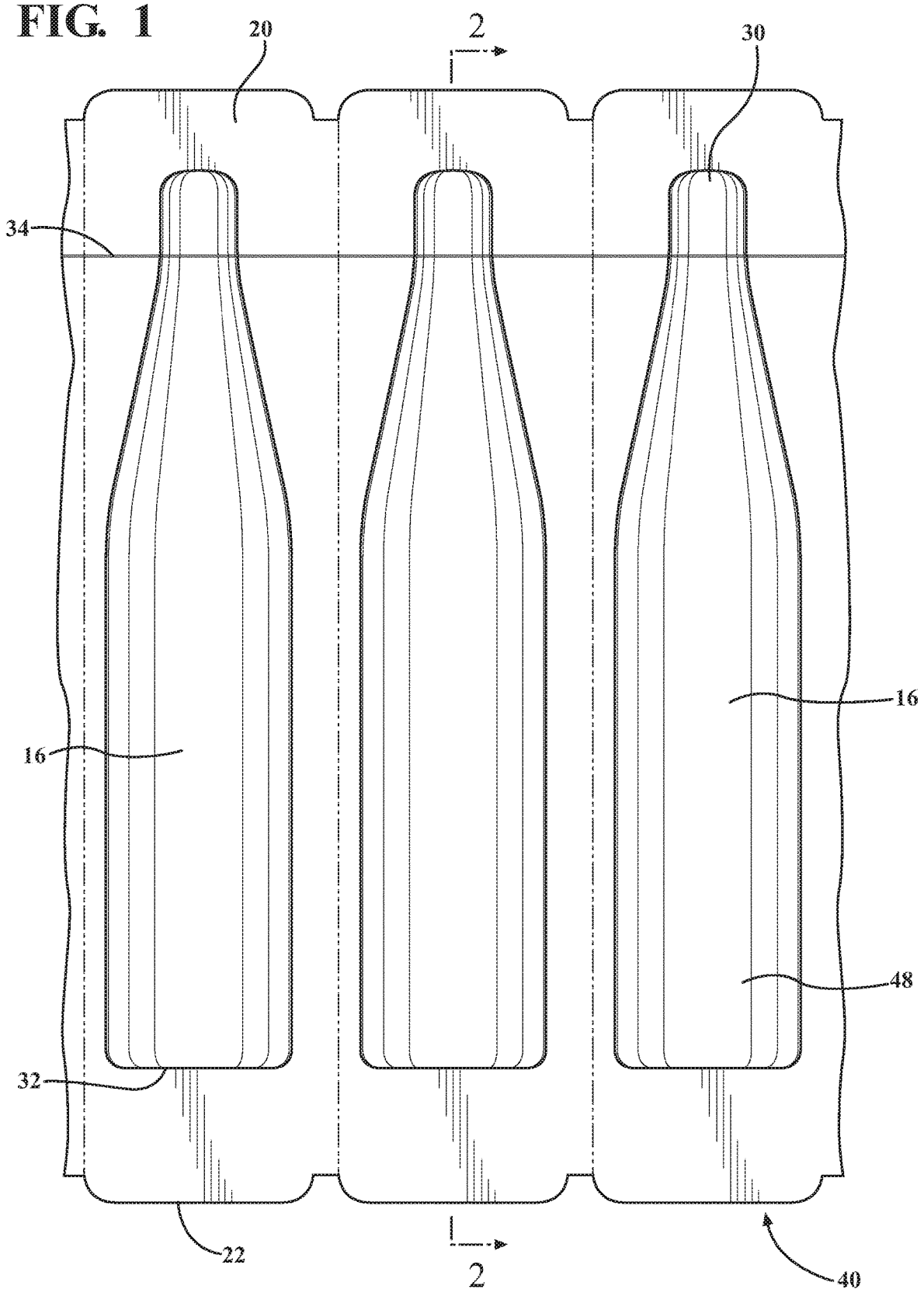
FIG. 1 shows a strip of vials in accordance with the invention.
Figure 4:
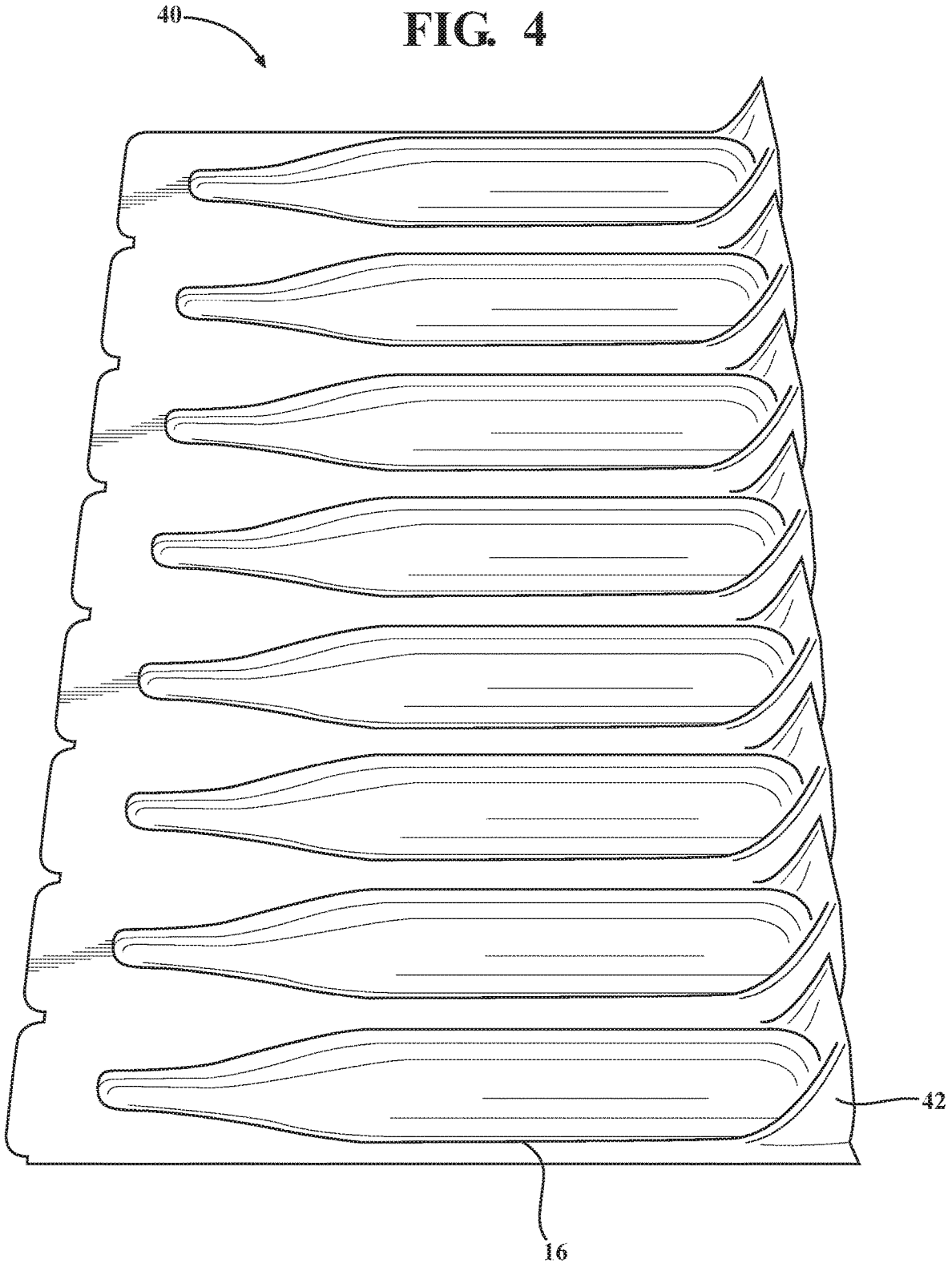
FIG. 4 is a perspective view of a strip of vials which are unfilled.

The method of forming and filling the vials includes placing two sheets 37, 38 of thermoformable material in a female mold with male mold inserts between the sheets to form the cavity. The outer female molds have cavities to define the raised profile and have flat surfaces forming planar portions that extend around the raised profile. The sheets are then thermoformed to form a strip 40 with raised profiles as shown in FIGS. 1, 4 and 5.

Figure 5:
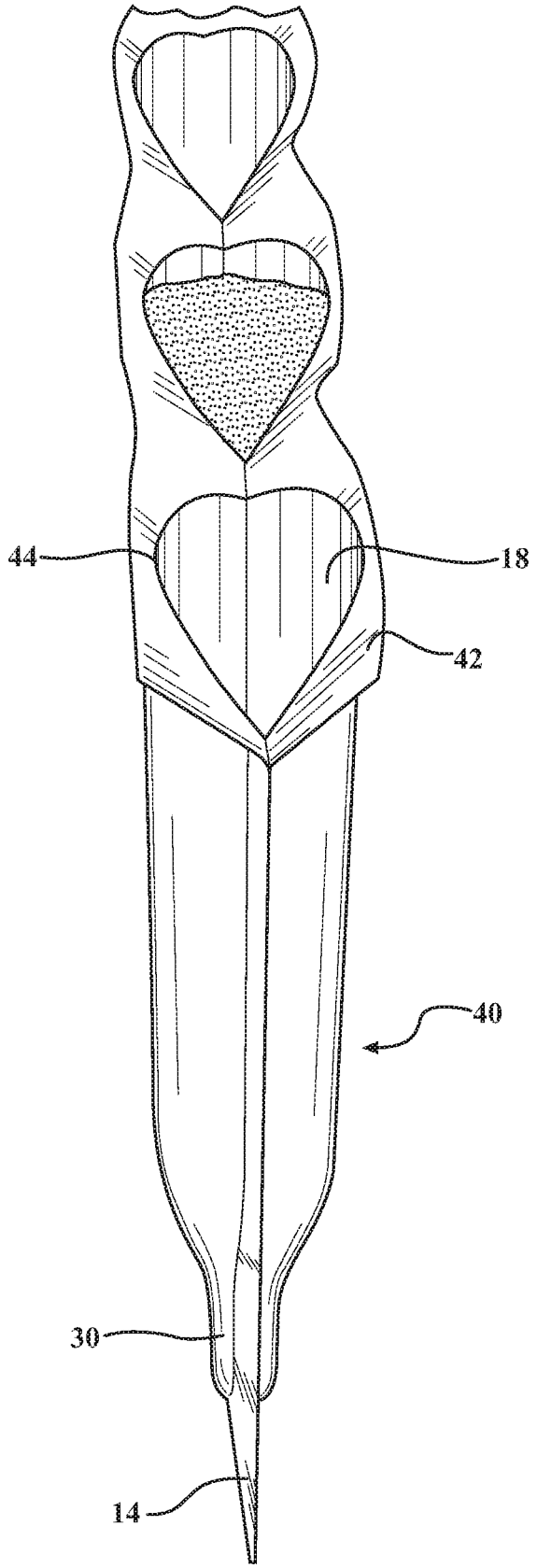
FIG. 5 is a top perspective view of unfilled vials with the flanges extending from the openings in accordance with the invention.

As shown in FIGS. 5, flange portions 42 to extend from an opening 44 are also formed at the bottom 32 of the vial to form a strip 40 of vials formed side by side. The flange portions 42 are bent slightly outwardly from the opening 42 to allow access for filling the vial. Once molded, the vial strip 40 is moved to a fill machine. The strip 40 of vials is inverted and held with the spouts 28 pointed downwardly. The contents 11 such as viscous liquid or semisolid material as filled through the opening 44 forcing air that was already within the cavity 16 into the spout portion, compressing the air. The strips 40 are then moved to a seal machine which bends the flange portions 42 inwardly and seals the flange portions 42 together and from the bottom wall 35. The strips 40 are then moved to a scoring machine which forms separation scores 46 between the vial bodies and the parting line 34. The parting line 34 extends from side to side between those edges 26 and runs across the spout 28 to provide the opening of the vial.

Once sealed, the contents and air rigidify the profile. When opening, the top 20 of the vial is grasped and bent away from the parting line 34. As shown in FIG. 3, the parting line 34 across the spout 28 breaks and the raised profile 16 then becomes soft allowing dispensing of the contents by squeezing the cylindrical portion 26 to displace the contents 11 through the spout 28 and opening 36 formed by the break.

The invention claimed is:

1. A vial for holding contents; comprising;

a body having a single flexible top sheet and a single bottom sheet formed of a plastic material, the plastic material being a laminate of PVC/EVOH/PE, with a PE layer of the top sheet being adhered to a PE layer of the bottom sheet, the body having a pair of parallel sides, a top end and a bottom end, each parallel side extending in a straight line from top end to the bottom end, the body having a raised portion defining a cavity for holding the contents and a peripheral planar portion extending between the raised portion and the parallel sides, the raised portion extending outwardly in opposed directions from the peripheral planar portion, the raised portion having a conical spout portion extending toward the top end, the body further having a parting line defined by cuts extending partially through the spout portion of the top sheet the parting line extending orthogonally between the pair of parallel sides to define a top portion and a bottom portion of the body such that when the top portion is bent towards the bottom portion the spout portion of the top sheet separates only along the parting line defined by the cuts and the bottom sheet remains intact opening the spout to access the contents of the cavity.

2. The vial of claim 1 wherein the parting line has a depth of generally 50% of the thickness of the top sheet.

* * * * *